United States Patent [19]

Wyatt

[11] 4,211,071

[45] Jul. 8, 1980

[54] VAPOR GENERATORS

[75] Inventor: William G. Wyatt, Dallas, Tex.

[73] Assignee: Vapor Energy, Inc., Grand Prairie, Tex.

[21] Appl. No.: 907,694

[22] Filed: May 19, 1978

[51] Int. Cl.[2] ..... F02C 7/00

[52] U.S. Cl. ..... 60/39.55; 431/351

[58] Field of Search ..... 60/39.05, 39.53, 39.55, 60/39.58, 39.59; 431/10, 351

[56] References Cited

U.S. PATENT DOCUMENTS

| | | | |
|---|---|---|---|
| 1,342,901 | 6/1920 | Good | 431/10 |
| 1,531,475 | 3/1925 | Brandt | 60/39.55 |
| 3,980,137 | 9/1976 | Gray | 166/303 |

FOREIGN PATENT DOCUMENTS

| | | | |
|---|---|---|---|
| 140156 | 3/1920 | United Kingdom | 60/39.58 |
| 271706 | 5/1927 | United Kingdom | 60/39.55 |
| 283290 | 1/1928 | United Kingdom | 60/39.55 |

*Primary Examiner*—Louis J. Casaregola

*Attorney, Agent, or Firm*—Thomas L. Cantrell; Joseph H. Schley

[57] ABSTRACT

Disclosed is an improved vapor generator of the kind in which a fuel-air mixture is combusted in a chamber through which water is flowed. The water acts as a coolant for the unit and is vaporized or converted to steam in the chamber in the presence of the flame. The steam formed from the feed water, the steam formed as a product of combustion, and the non-condensibles remaining after combustion issue from the chamber as a hot mixture suitable for a variety of uses, such as process steam, comfort-heating steam, and the like. The improvements include means for dividing the air feed into two parts, and means for forming a well-mixed stoichiometric mixture of fuel and the air of one part, which mixture is ignited and burned in a prechamber surrounded by and cooled by the air of the other part. The second part of the air is fed into the mid-region of the so-formed flame in the main chamber to lean it out and insure completeness of combustion, reducing production of carbon monoxide to extremely low levels. The mid-region of the flame is shielded from direct radiative or convective contact with the feed water flowing into the main chamber. The final region of the flame is brought into good direct radiative and convective contact with the feed water to vaporize it.

5 Claims, 1 Drawing Figure

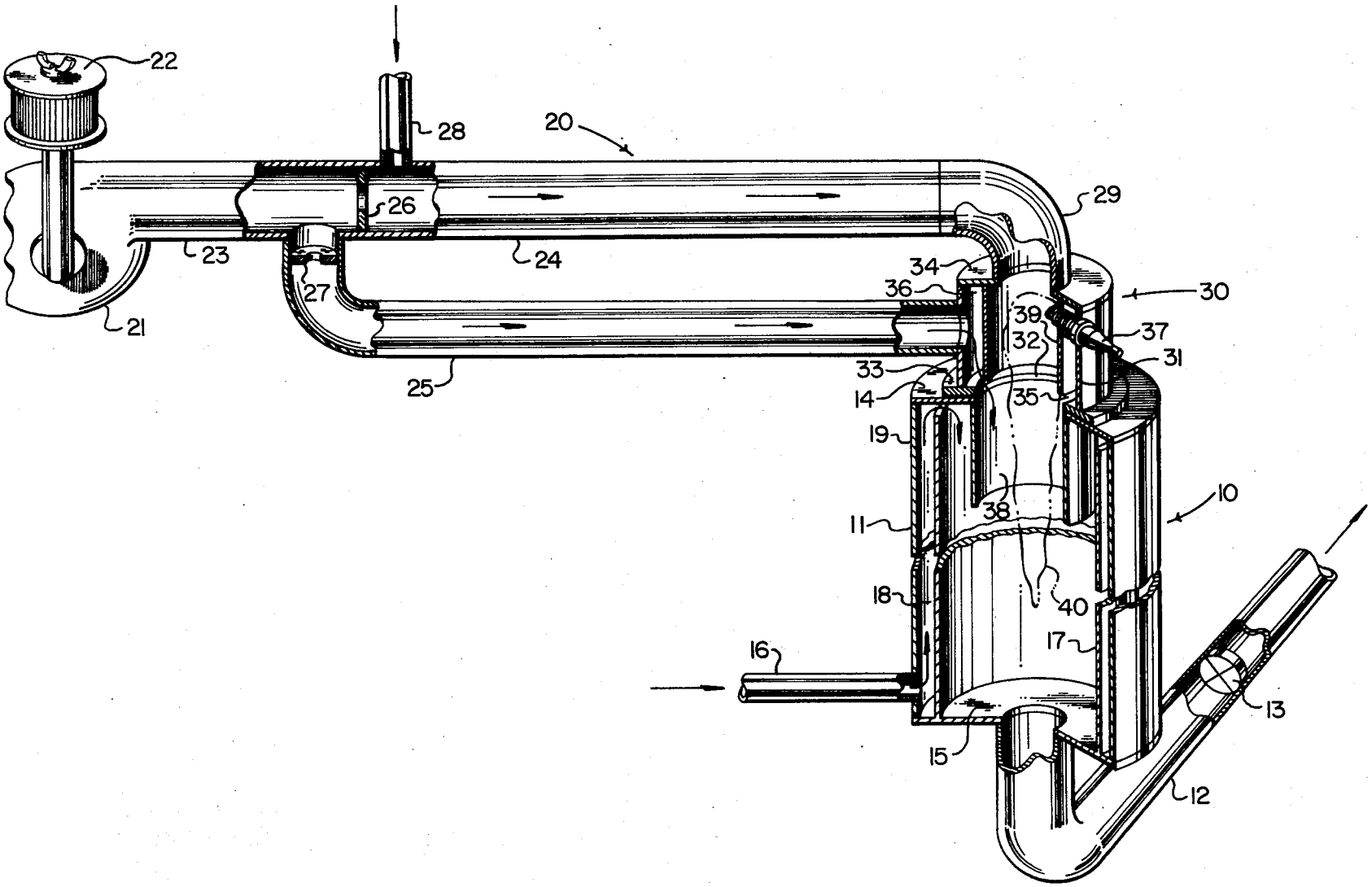
10
11
12
13
14
15
16
17
18
19
20
21
22
23
24
25
26
27
28
29
30
31
32
33
34
35
36
37
38
39
40

VAPOR GENERATORS

BACKGROUND OF THE INVENTION

Vapor generators of the kind in which a fuel-air mixture is combusted in the direct presense of feed water to produce a useful mixture of steam and non-condensibles are known. See the vaporizers shown in U.S. Pat. No. 3,980,137 and British Pat. No. 283,290. Other similar equipment is shown in: U.S. Pat. Nos. 1,483,917, 2,168,313, 3,563,028, 3,101,592 and 3,449,908.

One difficulty which has been encountered in vaporizers in the past is that of high carbon monoxide content in the product vapor, which is objectionable for many applications and dangerous for some of them. High carbon monoxide production is traceable to incomplete combustion, which is in turn traceable in part to difficulties in maintaining a stable lean flame, and in part to excessive quenching of the flame through direct radiative and convective contact between the flame and the feed water.

SUMMARY OF THE INVENTION

In accordance with the present invention a vapor generator is provided in which several inter-related means are employed to improve the quality of combustion in the generator so that a product stream substantially free of carbon monoxide results. In its preferred form, air (or another combustion supporting gas such as pure oxygen) is compressed and fed into a conduit system leading to the vaporizer. The conduit system includes a main line and a branch line, both of which are provided with suitably sized orifice plates for dividing the air into a main feed stream and an auxiliary feed stream in a selected volumetric or mass ratio.

Immediately downstream of the main air stream orifice, fuel is introduced into the main line at a rate sufficient to form a stoichiometric mixture with the air passing through the main line. The preferred fuel is gaseous, such as natural gas or hydrogen. By introducing the fuel in the turbulent region downstream from the main line orifice plate, assurance is obtained that good mixing of the fuel and air will result. Further assurance of good mixing is obtained by passing the fuel-air mixture through a relatively long length of conduit between the point of formation of the mixture and its point of ignition. Preferably, the stretch of conduit devoted to mixing includes at least one right angle bend, which serves to cause additional turbulence.

The stoichiometric fuel-air mixture is then introduced into a precombustion chamber where it is ignited. The rate of feed is faster than the flame propagation speed so that the flame does not migrate upstream into the conduit. The precombustion chamber includes a cylindrical flame-confining skirt within it. The auxiliary air feed stream is fed through its conduit into the annular space between the skirt and the outer wall of the precombustion chamber, where it cools the skirt and is itself preheated.

The precombustion chamber, in the preferred embodiment, is mounted at the upper end of the vaporizer unit itself, which comprises the main combustion chamber. The vaporizer unit is preferably an upright cylinder having an annular water jacket therearound. Water is fed into the lower end of the jacket, through which it flows upwardly, and at the upper end of the jacket it is fed into the main combustion chamber and directed downwardly along the chamber walls.

The precombustion chamber is positioned with respect to the main combustion chamber so that the flame struck in the prechamber extends downwardly into the main combustion chamber. The auxiliary preheated air stream escapes from the annular space in the precombustion chamber by flowing past the bottom edge of the flame confining skirt and enters the main combustion chamber, where it joins the flame. The addition of excess air (or oxygen) to the flame serves to lean it out and provide sufficient oxidizing material to convert substantially all the carbon in the fuel to carbon dioxide, instead of converting some fraction of it to carbon monoxide.

In the upper end of the main combustion chamber a second depending cylindrical flame confining skirt is provided. This skirt shields the portion of the flame adjacent the upper end of the chamber from full convective and radiative contact with the film of feed water flowing down the inner wall of the vaporizer. In this manner, excessive cooling or quenching of this portion of the flame is prevented, which contributes to the attainment of complete combustion.

In the main combustion chamber the flame extends downwardly past the lower end of the main chamber flame confining skirt. Thus the bottom portion of the flame is in full radiative and convective contract with the feed water flowing down the chamber wall. The feed water vaporizes and joins the hot combustion products (steam and noncondensibles) to form the product stream, which leaves the vaporizer via a conduit connected to its bottom. A valve is included in the outlet conduit to provide a means for controlling back pressure in the vaporizer.

In addition to providing extremely good combustion efficiency and low concentrations of carbon monoxide, the vaporizer of the invention retains the excellent heat efficiency characteristic of earlier forms of vaporizer.

From the foregoing discussion, it can be seen that in accordance with the invention a three-zone flame is established and maintained in the vaporizer: in the first zone, a stoichiometric mixture is ignited and burned under shielded conditions which insure flame stability; in the second zone, excess air is introduced to the flame under shielded conditions to insure completion of combustion; and in the third zone the flame is exposed to the feed water to vaporize it and quench the flame, after combustion has been completed.

DESCRIPTION OF THE DRAWING

The single FIGURE of the drawing is a somewhat diagrammatic illustration, partly in elevation and partly in perspective, of a vaporizer constructed in accordance with the invention.

DESCRIPTION OF A PREFERRED EMBODIMENT

In the drawing, the vaporizer of the invention is designated generally as 10. The primary component thereof is the vaporizer proper or main combustion chamber 11. Chamber 11 is preferably an upright closed-ended elongated cylinder adapted to enclose the bulk of the flame generated in accordance with the invention. To the bottom of chamber 11 is connected a product exit line or conduit 12, in which is mounted a back-pressure control valve 13, which is shown quite diagrammatically.

Chamber 11 has a cylindrical outer wall 19, and closed ends 14, 15. Provision is made for the delivery of feed water to the interior of the main combustion chamber. These provisions include water inlet line 16, and internal cylindrical wall or tube 17. Tube 17 is attached to bottom end 15 and terminates a selected relatively small distance short of top end 14. An annular space 18 is thus established between walls 19 and 17 extending over substantially the full height of chamber 11.

In operation, feed water is delivered into annular space 18 through inlet line 16. The water cools the unit and is warmed as it rises through the annular space or jacket 18. The water then spills over the top edge of tube 17, and flows down its inner wall. As will be explained more fully hereinbelow, during the first part of the downward travel, the water absorbs heat conductively from a shielded portion of the flame. During the final part of its downward flow, the feed water is in direct radiative and convective contact with part of the flame, and is vaporized thereby to form steam that becomes part of the product stream leaving chamber 11 via conduit 12.

The fuel and air delivery system of the invention is designated generally as 20. It includes an air compressor 21, having an air filter 22, both of which are shown diagrammatically. Various types of compressors having suitable output pressures and delivery rates may be employed. The compressed air issuing from compressor 21 enters conduit 23.

The compressed air stream in conduit 23 is divided into two streams bearing a selected ratio (volumetric or mass) to each other. The division is accomplished by providing mixing conduit 24, which is an extension of air conduit 23, and branch or auxiliary air conduit 25. Conduits 24 and 25 are each connected to the precombustion chamber discussed more fully hereinbelow. Air flow dividing orifice plates 26 and 27 are mounted in conduits 24 and 25 adjacent the branching or division point, and the orifices in the plates are sized to bring about the desired division of the air flow. Preferably, the flow through auxiliary air conduit 25 amounts to about 8 to 10 percent of the air flow through mixing conduit 24.

Immediately downstream of orifice plate 26 in mixing conduit 24 there is provided a fuel inlet 28. Flow in conduit 24 just downstream of the orifice in plate 26 is quite turbulent, and it is desirable to introduce the fuel at this point to initiate thorough and intimate mixing of the fuel and air. Furthermore, it is preferred that mixing conduit 24 be fairly long in order to provide a full opportunity for thorough mixing of the air and fuel stream before it reaches the precombustion chamber. Mixing is also enhanced by the directional change in conduit 24 at bend or elbow 29. The diameter of mixing conduit 24 is selected in view of the desired flow rate so that the lineal velocity of the mixture flowing therethrough is substantially equal to or slightly greater than the flame propagation speed, so that the flame established and maintained in the precombustion chamber will not migrate back up into conduit 24 or its bend 29. For example, with a designed fuel flow of 17 cubic feet per hour, mixed with a stoichiometric quantity of air, a nominal conduit diameter of about 2 inches is satisfactory.

The precombustion chamber of the invention is designated generally as 30. It includes a cylindrical housing 31, somewhat larger in diameter than opening 32 in the upper end 14 of chamber 11. Housing 31 is attached to upper end 14 by means of flange 33. The upper end of housing 31 is closed by plate 34. A flame enclosing skirt or shield 39 depends downwardly from plate 34, terminating short of opening 32 and flange 33 so that a circular slot 35 is defined between the edge of the skirt and the edge of the flange. A cylindrical annular space 36 is defined by skirt 39 and housing 31. Conduit 24 is attached to the top of the precombustion chamber to deliver a fuel-air mixture into the space within shield 39, and conduit 25 is attached to the side of the precombustion chamber to deliver auxiliary air into annular space 36.

A spark plug 37 passes thru housing 31 and shield 35 of the precombustion chamber 30, and means (not shown) are provided for striking a spark on the plug when desired.

In the vaporizer 11, a second flame enclosing shield or skirt 35 is mounted on top end 14 to depend downwardly from opening 32.

With the foregoing detailed description of the equipment of the invention in hand, an outline of its mode of operation can be given with reference to that description.

Compressor 21 is driven to draw air in through compressor 21 and deliver it under pressure into conduit 23. The air stream is split into two parts at the juncture of conduits 24 and 25 with conduit 23. The proportioning of the air stream split is fixed by orifice plates 26 and 27, with the main portion of the air entering conduit 24, and a minor portion, 8–10 percent, entering conduit 25.

Just downstream in conduit 24 from orifice plate 26 fuel is introduced through line 28 at a rate sufficient to form a stoichiometric mixture with the air flowing through line 24. The turbulence downstream of plate 26 initiates good mixing of the fuel and air, and the relatively great length of conduit 24, including bend 29, insures thorough and intimate mixing.

The fuel-air mixture is delivered from condiut 24 into the top of precombustion chamber 30, where it is ignited. The initial ignition is by means of spark plug 37, and the flame 40 struck by it is self-sustaining. Ignition and maintenance of the flame are relatively easy, because the mixture being combusted within precombustion chamber 30 is essentially stoichiometric, that is relatively rich.

The auxiliary airstream is delivered through conduit 25 to annular space 36 of the precombustion chamber, where it cools shield 39 and is itself preheated. It flows through slot 35 into the main combustion chamber where it joins the portion of the flame 40. The addition of the excess air serves to lean out the flame and insure that sufficient oxygen is present to drive the combustion reactions to completion, and in particular to oxidize substantially all carbon to carbon dioxide. The lean flame at the entrance region of the main combustion chamber is shielded from excess quenching by the feed water by shield 38, to further assure complete combustion.

The flame 40 extends downwardly in the main combustion chamber past the bottom of shield 38, and its downward extension is in radiative and convective contact with the feed water flowing down the walls of tube 17. Good heat transfer occurs, and the water is vaporized to steam which joins the combustion products of the flame to exit through conduit 13.

What is claimed is:

1. A vapor generator comprising:

an upright cylindrical jacketed vessel having a product stream conduit connected to the bottom thereof and a flame inlet at the top thereof;

means for introducing water into the jacket of said vessel adjacent the bottom thereof;

means for delivering water from said jacket to the interior of said vessel adjacent the top thereof;

a precombustion chamber mounted atop said vessel in a position to deliver a flame through said flame inlet said precombustion chamber comprising a cylindrical housing having a cylindrical depending first shield positioned therein;

means for delivering a stream of fuel and combustion supporting gas into said precombustion chamber connected to deliver said stream into the top of said precombustion chamber within said first shield;

means for delivering a stream of excess combustion supporting gas into the top of said vessel connected to deliver said stream into said precombustion chamber exteriorly of said first shield and thence past the lower edge of said first shield into the top of said vessel; and a second cylindrical shield depending from said flame inlet downwardly into said vessel to bring said water delivered into the interior of said vessel into conductive contact with said flame while shielding it from radiative and conductive contact with said flame.

2. A vapor generator in accordance with claim 1 in which said means for delivering said streams of gas comprise:

compressor means for compressing combustion supporting gas connected to a first conduit for conveying said compressed gas;

a second conduit connected to receive a major portion of said compressed gas and deliver it to said precombustion chamber;

means for introducing fuel into said second conduit;

a third conduit connected to receive a minor portion of said compressed gas and deliver it toward said flame inlet; and flow dividing means in said second and third conduits.

3. A vapor generator in accordance with claim 2 in which said flow dividing means comprise orifice plates.

4. A vapor generator in accordance with claim 3 in which said means for introducing fuel into said second conduit comprises a fuel inlet immediately downstream from the orifice plate in said second conduit.

5. A vapor generator for generating a mixture of steam and non-condensibles essentially free of carbon monoxide from carbon containing fuel and combustion supporting gas comprising:

an upright cylindrical jacketed vessel having a product stream conduit connected to the bottom thereof and a flame inlet at the top thereof, for confining a flame and bringing it into heat transfer relationship with a stream of feedwater;

a precombustion chamber mounted atop said vessel in position to deliver a flame through said flame inlet, said precombustion chamber comprising a cylindrical housing having a cylindrical depending first shield positioned therein to divide said precombustion chamber into an inner flame chamber and an outer surrounding annular chamber communicating with said inner chamber at its lower edge;

means for striking a flame in said inner flame chamber of said precombustion chamber;

a cylindrical second shield depending from said flame inlet downwardly into said vessel to establish an annular shielded region in the upper portion of said vessel;

compressor means for compressing combustion supporting gas connected to a first conduit for conveying said compressed gas;

a second conduit connected between said first conduit and the top of the inner flame chamber of said precombustion chamber;

a third conduit connected between said first conduit and said outer surrounding annular chamber;

flow dividing means for dividing the gas flowing in said first conduit into two streams bearing a fixed ratio to each other, and delivering the larger of said streams into said second conduit and the smaller of said streams into said third conduit, said flow dividing means being constructed and arranged to create turbulent flow in said second conduit;

a fuel inlet positioned to deliver fuel into the turbulently flowing gas in said second conduit;

means for delivering water into the jacket of said vessel adjacent the bottom thereof; and means for delivering said water from said jacket to the interior walls of said vessel adjacent the top thereof and exteriorly of said second shield;

whereby, upon operation of said compressor, delivery of fuel to said fuel inlet, delivery of water to said water delivery means, and operation of said flame striking means, a flame having three distinct zones is established and maintained in said precombustion chamber and extending into said vessel, the first of said zones being located in said precombustion chamber and within the inner flame chamber thereof, and being substantially stoichiometric and thus relatively rich, said first zone of the flame preheating combustion supporting gas flowing through said outer surrounding annular chamber toward said vessel;

said second flame zone being located in said vessel within said second shield, and being relatively leaned out by preheated combustion supporting gas introduced from said outer surrounding annular chamber, said second zone being in conductive heat transfer contact with feedwater flowing down the walls of said vessel exteriorly of said second shield, but shielded from radiative and convective contact therewith by said second shield to thereby assure completeness of carbon combustion; and said third flame zone being located in said vessel in the portion thereof below said second shield and in radiative and convective heat transfer contact with feedwater flowing down the walls of said vessel to thereby assure complete vaporization thereof.

* * * * *